United States Patent [19]

Cook

[11] Patent Number: 5,052,898

[45] Date of Patent: Oct. 1, 1991

[54] BENT AXIS COMPRESSOR

[76] Inventor: Cleo E. Cook, Jacksonville, Fla.

[21] Appl. No.: 532,929

[22] Filed: Jun. 4, 1990

[51] Int. Cl.[5] ..... F04B 1/24

[52] U.S. Cl. ..... 417/269; 417/271; 91/500

[58] Field of Search ..... 417/269, 271; 123/43 A; 91/500; 92/82, 142

[56] References Cited

U.S. PATENT DOCUMENTS

| | | | |
|---|---|---|---|
| 1,986,584 | 1/1935 | Koplar | 91/500 |
| 3,902,468 | 9/1975 | Turner | 91/500 |
| 4,060,060 | 11/1977 | Turner | 91/500 |
| 4,867,650 | 9/1989 | Ikeda et al. | 417/269 |
| 4,930,995 | 6/1990 | Suzuki et al. | 417/269 |

*Primary Examiner*—Leonard E. Smith

*Assistant Examiner*—Alfred Basichas

*Attorney, Agent, or Firm*—Arthur G. Yeager

[57] ABSTRACT

A bent-axis compressor, particularly suitable for compressing refrigerant vapors, in which a plurality of spaced bent-axis double acting reciprocating pistons are operatively joined to two separate rotatable cylinder blocks driven by a power transmission around a stationary bent axis central shaft; the improved arrangement in which the central shaft and the pistons are hollow, a vapor inlet port is located at the center of each piston at the plane joining the two halves of the piston and on the side having an exterior obtuse included angle between the two halves, valved passageways leading from inside the piston to each head of the respective cylinder, and from the cylinder head to the interior of the central shaft for exit therefrom as a compressed vapor.

20 Claims, 4 Drawing Sheets

BENT AXIS COMPRESSOR

TECHNICAL FIELD OF THE INVENTION

This invention relates to mechanical apparatus, more particularly, to vapor of gas compressors.

BACKGROUND ART

Reciprocating piston engines and/or compressors have been known for many years, and for a variety of reasons some engines and/or compressors were developed with single end pistons operating at an angle wherein the angle between pistons is 180° . Rotary piston engines have also been developed where the pistons reciprocate along a radius of a circle. More recently attention has been directed to engines employing double-ended pistons with each half of the piston set at an angle to the other half. Separate cylinder blocks house opposite ends of the same bent-axis pistons, and by rotating the cylinder blocks around a central shaft the piston ends are caused to reciprocate in their own cylinders. Typical of engines and compressors employing this principle are those shown in U.S. Pat. Nos. 3,830,208; 3,902,468; 3,905,338; 3,973,531; and 4,060,060.

It has now been found that improved operation and efficiency can be obtained by providing a new arrangement for vapor flow through a compressor of the general bent-axis type, and that other advantages are provided by these new designs.

Accordingly, it is an object of this invention to provide a novel bent-axis vapor compressor. It is another object of this invention to provide a bent-axis type of compressor wherein the vapor to be compressed enters into the inside of hollow pistons and flows to the head of the cylinder where it is compressed and then exits through the interior of a hollow central shaft. Still other objects will become apparent from the more detailed description which follows.

BRIEF DESCRIPTION OF THE INVENTION

This invention relates to a vapor compressor having a plurality of bent-axis double-ended pistons with two separate cylinder blocks having straight-axis cylinders to mate sliding with the pistons as the cylinder blocks rotate around a stationary bent axis central shaft, each piston including two half pistons joined to each other in a plane common to all the pistons to form an included acute angle on one side of the piston and an included obtuse angle on the opposite side of the piston; and a power transmission means attached to one of the cylinder blocks; the improvement which comprises:

a. each piston being hollow and with a vapor inlet port at said obtuse angle to admit vapor from outside the piston to flow into the inside of the piston;
b. valve means at each end of each piston to permit vapor to flow from inside the piston to outside the piston into the head of the cylinder mating with that piston;
c. the central shaft having a single uninterrupted hollow extending from a closed end inside the engine to an open end outside the engine;
d. radial passageway means between the head of each cylinder and the hollow of the central shaft; and
e. stationary vapor-tight housing around the compressor with a vapor inlet port passing through the housing.

In specific and preferred embodiments of the invention the valves at the ends of the pistons are one-way check valves, such as poppet valves or reed valves; the inlet port in each piston includes a baffle to direct the inlet vapors toward the ends of the pistons; the vapor passageway between the cylinder block and the central shaft hollow is fitted with a seal which is affixed to the cylinder block; the cylinder blocks and pistons are encased in and spaced inwardly from a stationary housing which serves as a vapor collection space from which vapors are drawn into the pistons; and bent-axis drive pins are employed to connect the two rotating cylinder blocks in power transmission functions.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION AND BEST MODE

Figure 1:
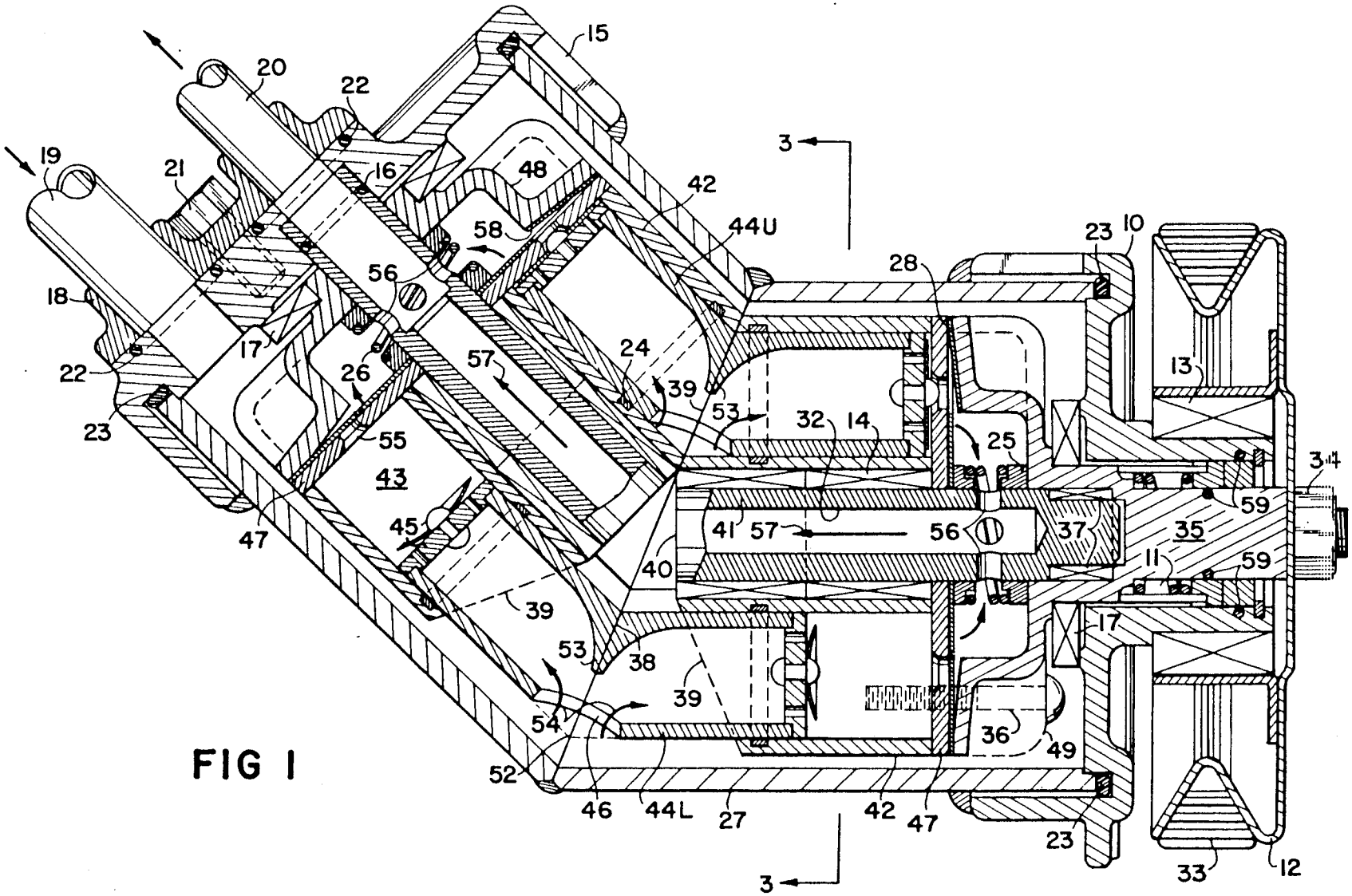
FIG. 1 is a lengthwise cross-sectional view of the compressor of this invention generally taken at 1—1 of FIG. 3.

The invention and its novel features are best understood by reference to the attached drawings.

The compressor of this invention includes two rotatable cylinder blocks 42 with a plurality of about 2-6 cylinders in each block adapted to receive a plurality of double-ended pistons 44. For the purposes of the compressor of this invention the preferred number of cylinders and pistons is four as shown in the drawings, i.e., four cylinders and four pistons, and the description will be directed to such an arrangement although it is to be understood that other numbers of cylinders and pistons can be employed in a similar arrangement.

Cylinder blocks 42 rotate on bearings 14 around a central axis or shaft 41 which is of the bent-axis type with the included angle 50 between the axes of shaft 41 being about 120° to 150°, preferably about 135°. The opposing faces of the two cylinder blocks 42 are in the shapes of identical truncated cones. Surfaces 39 are conical and faces 40 are planar and perpendicular to the respective axes of the two halves of bent axle 41, which is stationary. Pistons 44 fit slidably in the respective cylinders of blocks 42. As blocks 42 rotate around the respective halves of axle 41, pistons 44 will be between the open position as shown in the lower half of FIG. 1 with a maximum piston displacement volume 43 at each end of that piston to the closed position as shown in the upper half of FIG. 1 where the space between the piston 44 and the end of the respective cylinder is substantially zero, or as close thereto as possible. As one cylinder block 42 is rotated it transmits its torque to the pistons 44 which slide to accommodate the torque which, in turn, causes the other cylinder block 42 to rotate in the same direction as the driving cylinder block. This is the typical movement, well known in the prior art of bent-axis engines.

The cylinder blocks 42, pistons 44, and axle 41 are enclosed in a housing comprising a central body 27 with a front enclosure cover 10 and a rear enclosure cover 15 with the housing being spaced outwardly from the moving parts of the compressor so as to leave a space therebetween that is filled with the vapors of the substance being compressed, e.g., a refrigerant such as FREON fluorochlorocarbon. This space is connected to suction pipe 19 which leads to a supply (not shown) of the vapor to be compressed.

Pistons 44 are hollow with a vapor inlet port 46 at the apex of each double piston, the apex being the location on plane 38 where the included angle between the outsides of the piston walls is the largest, i.e., adjacent intersection 52 when the piston is in position shown as the lower piston in FIG. 1. Vapor enters through port 46 to the inside hollow of piston 44 and preferably directed by baffles 53 to the opposite ends of the piston 44 as shown by directional arrows 54. Vapor inside the hollow of pistons 44 flows through a suction check valve 45 preferably a poppet valve or reed valve 45 into the cylinder head space 43 where the vapor is compressed by the sliding movement of piston 44 with respect to cylinder block 42 and passes through discharge port 55 in discharge plate 47 and through flap valve 28 into the internal space enclosed by compressed vapor manifold 48 or 49 and then through radial exit ports 56 into the hollow center 32 of bent axle 41. The compressed vapors in hollow 32 flow in the direction of arrows 57 outward through discharge tube 20 for use elsewhere, e.g., expansion in a refrigeration cycle. Aligned with each exit port 56 are dynamic seals 25, held in place with springs 26. Seals 25 and springs 26 are affixed to cylinder blocks 42 and rotate around stationary axle 41. Compressed vapor manifolds 48 and 49 are affixed to cylinder blocks 42 by a plurality of retaining screws 36. Compression rings 24 are located in the stationary walls of the cylinder block 42 rather than on the movable piston, as in the normal internal combustion engine. Preferably rings 24 are made of Teflon tetrafluoraethylene polymer which has well known antifriction properties. The rings 24 are preferably positioned near the lower end of the cylinder, i.e., close to conical surface 39, which facilitates lubrication of the piston/-cylinder interface because lubricating oil will accumulate at rings 24 during the compression stroke of the pistons, and thereby lubricate the entire piston/cylinder interface. Generally, one ring per half-cylinder is sufficient, although more than one may be preferred for special types of compressors. Such compression rings prevent the escape of any compressed vapors from the head of each half-cylinder rearwardly along the piston/cylinder interface.

As cylinder blocks 42 rotate around axle 41 pistons 44 assume positions from the upper position 44U with substantially no head space between piston 44U and discharge plate 47, to the position 44L with the maximum head space 43. This movement compresses any vapor in head space 43 and pushes it out discharge port 55 and discharge flap valve plate 28. As cylinder blocks 42 continue to rotate, flaps 58 immediately return, respectively, to cover discharge ports 55 preventing the return of any compressed vapor from compressed vapor manifold 48 or 49 and thus causing a vacuum to form between the head of piston 44 and discharge plate 47 on the piston's down stroke. This vacuum opens suction valves 45 and is immediately relieved by incoming vapor entering the hollow of piston 44 through inlet port 46. Thus as rotation of cylinder blocks 42 continue compressed vapor is produced in cylinder head space 43 and pushed outwardly into manifolds 48 and 49 and then to hollow center 32 of axle 41 where it is removed through tube 20.

The compressor of this invention must be driven by a power source capable of rotating cylinder blocks 42. A typical example is shown in FIG. 1 including a pulley 12 mounted on a drive head 35 which is affixed to front cylinder head 49 by screws 36 and separated from axle 41 by bearings 37. A clutch mechanism may also be employed (not shown). The compressor is housed in an assembly including a tubular housing body 27, a front enclosure cover 10 and a rear enclosure cover 15, all of which may be sealed and held tightly together by using O-ring seals 23 with bolt-and-nut connections between covers and body or with welded connections. Pulley 12 rotates around stationary front enclosure cover 10 through bearings 13, and a seal assembly 11 separates hub 35 from enclosure cover 10, which may also include appropriate O-ring seal portions 59. Nut 34 attaches hub 35 to pulley 12, and V-belt 33 provides the rotational force from a source not shown, e.g., an electric motor or automotive engine.

Figure 2:
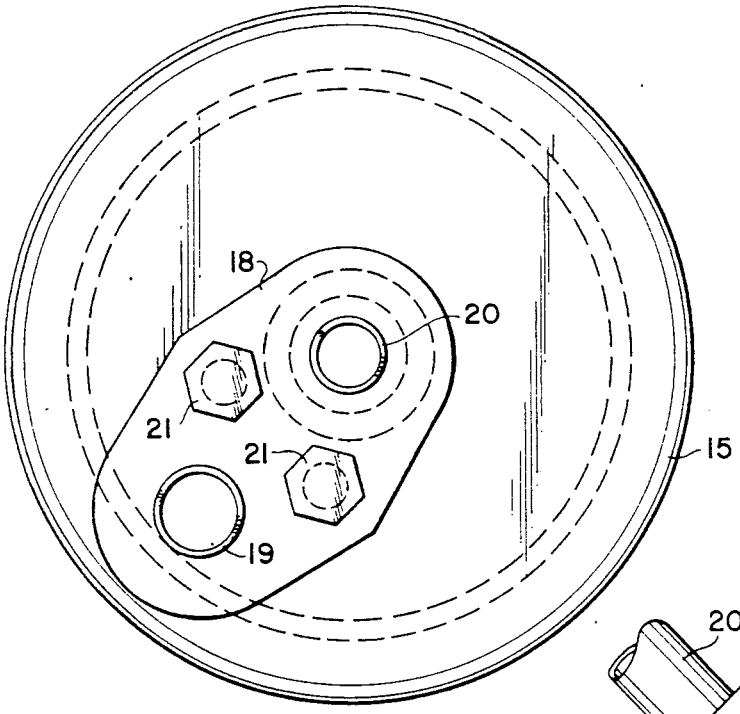
FIG. 2 is a top end plan view of the compressor of this invention taken at the vapor inlet/vapor outlet end.
Figure 6:
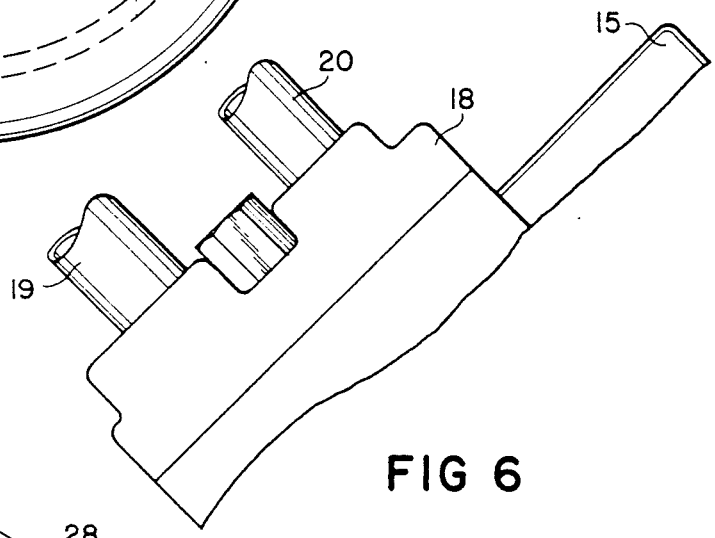
FIG. 6 is a partial side elevational view of the top end shown in FIG. 2.
Figure 4:
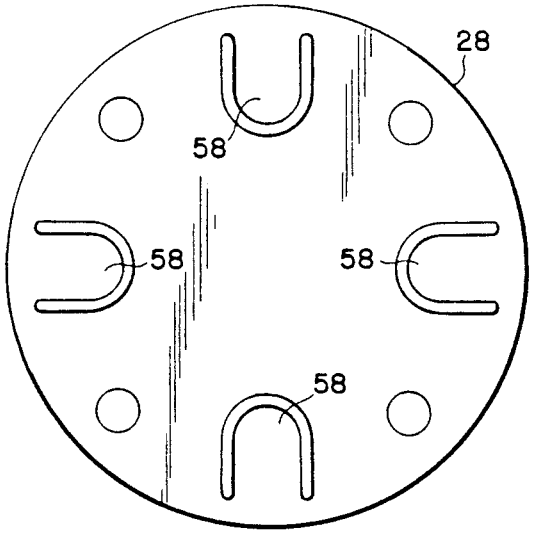
FIG. 4 is a top plan view of the composite discharge valve of this invention.

In FIGS. 2 and 6 there is shown the top outside structure of rear enclosure head 15 and the arrangement of suction tube 19 and discharge tube 20. Both tubes 19 and 20 pass through a flange 18 which is attached to rear enclosure cover 15 by bolts or screws 21. O-ring seals 16 (FIG. 1) seal cover 15 to axle 41. O-ring seals 22 (FIG. 1) seal suction tube 19 and discharge tube 20 to cover 15. Thrust bearings 17 (FIG. 1) are placed to join stationary cover 15 to rotating rear compressed vapor manifold 48.

Figure 5:
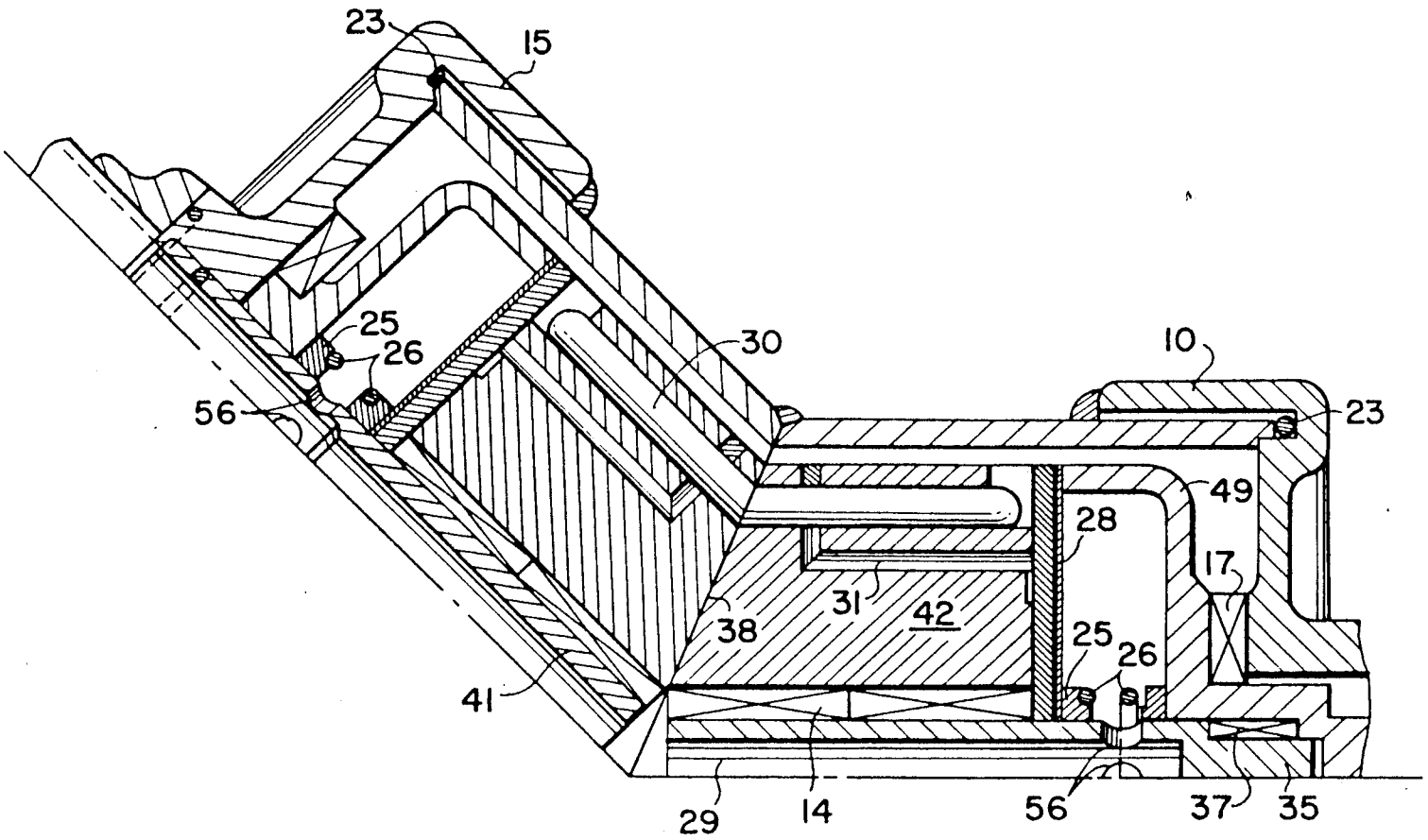
FIG. 5 is a longitudinal cross-sectional view of the two cylinder blocks and the drive pins taken generally at 5—5 of FIG. 3.

In order to properly absorb the torsional forces produced in driving cylinder blocks 42, it is preferred that torsion drive pins 30 be employed as shown in FIG. 5. Drive pins 30 are solid pins set in recesses in cylinder blocks 42. Pins 30 slide longitudinally in their respective recesses in the same manner as pistons 44 slide in cylinders in blocks 42. Pins 30 are lubricated by oil manifold which conducts oil-rich vapors from the compressed gas space at the end of the compression stroke.

Figure 3:
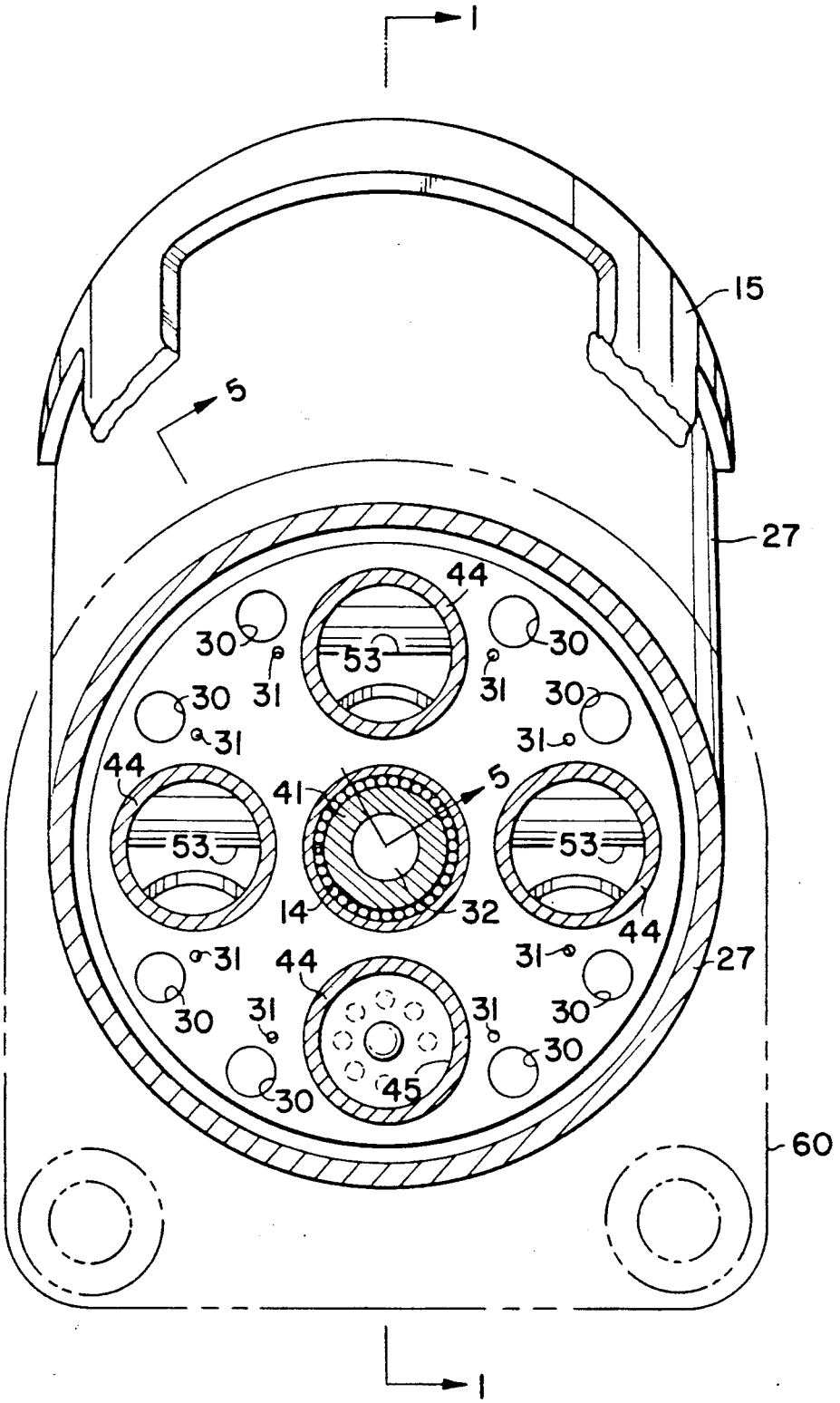
FIG. 3 is a lateral cross section taken at 3—3 of FIG. 1.

A frame 60 (FIG. 3) may be employed to hold the compressor in fixed position, e.g., by combining frame 60 and front closure head 10 into a single structure, and to mount it at an appropriate location in a refrigeration system involving a condenser, an evaporator, and the other necessary or desirable components of the system While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. In a vapor compressor having a plurality of bent-axis double-ended pistons with two separate cylinder blocks having straight-axis cylinders to mate sliding with the pistons as the cylinder blocks rotate around a stationary bent axis central shaft, each piston including two half pistons joined to each other in a plane common to all the pistons to form an included smaller obtuse angle on one side of the piston and an included larger obtuse angle on the opposite side of the piston; and a power transmission means attached to one of the cylinder blocks; the improvement which comprises:

a. each piston being hollow and with a vapor inlet port at said larger obtuse angle to admit vapor from outside the piston to flow into the inside of the piston;

b. suction valve means at each end of each piston to permit vapor to flow from inside the piston to outside the end of the piston into the head of the cylinder mating with that piston;

c. said central shaft having a single uninterrupted hollow extending from a closed end inside the compressor to an open end outside the compressor;

d. valved passageway means between the head of each cylinder and the hollow of the central shaft; and e. a stationary vapor-tight housing around the compressor with a vapor inlet port passing through the housing.

2. The compressor of claim 1 valve means of b. is a one-way check valve.

3. The compressor of claim 2 wherein the check valve is a poppet valve.

4. The compressor of claim 1 wherein each hollow piston has an internal baffle to divide the vapor entering the inlet port into two substantially equal portions and to direct the two portions to the two respective ends of the piston hollow.

5. The compressor of claim 1 wherein the valved passageway means of d. includes a first passageway from the exterior to the hollow of the central shaft aligned with a second passageway from the cylinder block to the central shaft, a vapor seal which is affixed to and rotates with the cylinder block while encircling the second passageway, and a one-way check valve permitting compressed vapor to flow from said cylinder to said second passageway.

6. The compressor of claim 5 wherein said check valve is a flap valve.

7. The compressor of claim 1 wherein the housing is stationary and spaced radially outwardly from the rotating cylinder blocks to form a vapor collection space around the cylinder blocks.

8. The compressor of claim 1 wherein the cylinders are equally spaced, angularly and radially around the central shaft.

9. The compressor of claim 8 wherein the cylinders are rigidly fixed in place in a housing which includes a plurality of bent-axis drive pins connecting the housings on both sides of the common plane and serving to transmit the torsion which drives the rotating cylinder blocks from one block to the other block.

10. The compressor of claim 1 wherein each said cylinder includes a compression ring seal affixed thereto to provide a seal against leakage of compressed vapors from said head of each respective cylinder.

11. In a vapor compressor having an elongated stationary bent-axis central shaft having two half-shafts joined to each other along a plane and a pair of spaced cylinder blocks adjacent respective ends of the shaft adapted to rotate thereabout, and a plurality of spaced bent-axis double-ended pistons linearly slidably disposed in straight-axis cylinders in a pair of respective cylinder blocks as said cylinder blocks rotate around said central shaft, each of the said pistons including a pair of half-pistons joined to each other at a plane common to all said pistons and passing through the plane between said half-shafts of the central shaft to form an included smaller obtuse angle on one side of the piston and an included larger obtuse angle on the opposite side of the piston; and a power transmission means attached to one of said cylinder blocks; the improvement which comprises each said piston being hollow and with a vapor inlet port located at said larger obtuse angle to admit vapor from outside said piston to flow into said hollow of said piston, each said cylinder block having a common compressed vapor manifold for said cylinders adjacent thereto, valve means at each end of each said half-piston to permit vapor to flow from said hollow of each said half-piston to said head of said cylinders mating with respective said half-piston and thence into said compressed vapor manifold respectively, said central shaft having a single elongated uninterrupted passageway extending from a closed end inside said compressor to an open end outside said compressor, a plurality of passageways between respective said head of each cylinder and said elongated passageway, and an elongated stationary vapor-tight housing around said cylinder blocks and said double-ended pistons with said central shaft extending through respective housing ends, said housing having a vapor inlet port passing therethrough to pass vapor into said hollows of said double-ended pistons.

12. The compressor of claim 11 wherein said valve means are check valves.

13. The compressor of claim 11 wherein said plurality of passageways includes a first passageway extending radially between said central shaft elongated hollow and a compressed vapor manifold and a second passageway extending between said compressed vapor manifold and respective said half-cylinder adjacent thereto.

14. The compressor of claim 12 further comprising second valve means for respectively maintaining said second passageways closed and opening same upon sufficient compression of vapor within respective said cylinder by respective said piston to force compressed vapor into said manifold.

15. The compression of claim 11 wherein each hollow piston has an internal baffle located at said larger obtuse angle to substantially equally divide the vapor entering said inlet port into two portions and to direct the two portions to said respective hollows of said two half-pistons and through open said valve means into said cylinder heads.

16. The compressor of claim 12 further comprising an automatic flap check valve pressed against said cylinders for rotation with said cylinder block and for opening to communicate said second passageway with said first passageway when sufficient compression of vapor occurs within respective said cylinder.

17. The compressor of claim 11 wherein the housing is stationary and spaced radially outwardly from said rotating cylinder blocks to form a vapor collection space around said cylinder blocks so that vapor is suctioned into said vapor inlet ports of said pistons.

18. The compressor of claim 11 wherein said cylinders are equally spaced, angularly and radially around said central shaft.

19. The compressor of claim 18 wherein said cylinders are rigidly fixed in place in said housing which includes a plurality of bent axis drive pins connecting said housing on both sides of said common plane and serving to transmit the torsion forces which drives said rotating cylinder blocks from one block to the other block, thereby relieving said pistons of such torsional forces.

20. The compressor of claim 11 which additionally comprises at least one compression ring in each said half-cylinder to prevent compressed vapors in the head of each said half-cylinder from escaping rearwardly along the piston/cylinder interface.

* * * * *